US007167131B2

(12) United States Patent
Martiskainen et al.

(10) Patent No.: US 7,167,131 B2
(45) Date of Patent: Jan. 23, 2007

(54) ANTENNA

(75) Inventors: Matti Martiskainen, Tiberias Illit (IL); Gennadi Babitski, Nesher (IL)

(73) Assignee: Galtronics Ltd., Tiberias (IL)

( * ) Notice: Subject to any disclaimer, the term of this patent is extended or adjusted under 35 U.S.C. 154(b) by 15 days.

(21) Appl. No.: 10/846,401

(22) Filed: May 14, 2004

(65) Prior Publication Data

US 2005/0007282 A1 Jan. 13, 2005

Related U.S. Application Data

(60) Provisional application No. 60/470,929, filed on May 14, 2003.

(51) Int. Cl.
*H01Q 1/24* (2006.01)

(52) U.S. Cl. ..... 343/702; 343/895; 343/725; 343/867; 343/901

(58) Field of Classification Search ..... 343/702, 343/895, 725, 867, 700 MS, 726, 729, 742, 343/715, 900–901
See application file for complete search history.

(56) References Cited

U.S. PATENT DOCUMENTS

| | | | | |
|---|---|---|---|---|
| 4,101,898 | A | | 7/1978 | Ingram |
| 4,161,737 | A | | 7/1979 | Albright |
| 4,328,501 | A | | 5/1982 | DeSantis et al. |
| 4,366,486 | A | | 12/1982 | Toulios |
| 4,443,803 | A | | 4/1984 | DeSantis et al. |
| 4,821,040 | A | | 4/1989 | Johnson et al. |
| 4,876,709 | A | | 10/1989 | Rogers et al. |
| 5,072,230 | A | * | 12/1991 | Taniyoshi et al. ..... 343/715 |
| 5,204,687 | A | | 4/1993 | Elliott et al. |
| 5,548,827 | A | | 8/1996 | Hanawa et al. |
| 5,936,583 | A | | 8/1999 | Sekine et al. |
| 6,069,592 | A | * | 5/2000 | Wass ..... 343/895 |
| 6,075,488 | A | * | 6/2000 | Hope ..... 343/702 |
| 6,091,369 | A | | 7/2000 | Baek et al. |
| 6,140,975 | A | | 10/2000 | Cohen |
| 6,201,500 | B1 | * | 3/2001 | Fujikawa ..... 343/702 |
| 6,211,818 | B1 | * | 4/2001 | Zach, Sr. ..... 342/357.07 |
| 6,298,243 | B1 | * | 10/2001 | Basile ..... 455/552.1 |
| 6,310,578 | B1 | * | 10/2001 | Ying ..... 343/702 |
| 6,448,934 | B1 | * | 9/2002 | Lee et al. ..... 343/702 |
| 6,476,766 | B1 | | 11/2002 | Cohen |
| 6,552,692 | B1 | * | 4/2003 | Zeilinger et al. ..... 343/792 |
| 6,611,691 | B1 | * | 8/2003 | Zhou et al. ..... 343/709 |
| 6,642,893 | B1 | * | 11/2003 | Hebron et al. ..... 343/702 |
| 6,693,600 | B1 | | 2/2004 | Elliott |
| 6,839,003 | B1 | * | 1/2005 | Soliman et al. ..... 341/50 |
| 2003/0048227 | A1 | | 3/2003 | Nakamura |
| 2003/0151556 | A1 | | 8/2003 | Cohen |

* cited by examiner

*Primary Examiner*—Tho Phan
*Assistant Examiner*—Chuc Tran
(74) *Attorney, Agent, or Firm*—Abelman, Frayne & Schwab

(57) ABSTRACT

A top-loaded whip antenna particularly suitable for use in a compact mobile communication device having dual band resonance and including an elongate conductive whip antenna portion and a choke defined over a portion of the elongate conductive whip antenna portion, thereby providing top loading.

15 Claims, 5 Drawing Sheets

ANTENNA

REFERENCE TO COPENDING APPLICATION

Reference is made to U.S. Provisional Patent Application Ser. No. 60/470,929 entitled SHORTENED WHIP STRUCTURE HAVING EXTENDED ELECTRICAL LENGTH AND DUAL BAND RESONANCE, filed May 14, 2003, the disclosure of which is hereby incorporated by reference and priority of which is hereby claimed.

FIELD OF THE INVENTION

The present invention relates to antennas and more particularly to whip type antennas.

BACKGROUND OF THE INVENTION

The following U.S. patent documents are believed to represent the current state of the art: U.S. Pat. Nos.: 6,693,600; 6,476,766; 6,140,975; 6,091,369; 5,936,583; 5,548,827; 5,204,687; 4,876,709; 4,821,040; 4,443,803; 4,366,486; 4,328,501; 4,161,737 and 4,101,898. U.S. Published Patent Application 20030048227.

SUMMARY OF THE INVENTION

The present invention seeks to provide an improved whip type antenna.

There is thus provided in accordance with a preferred embodiment of the present invention a top-loaded whip antenna particularly suitable for use in a compact mobile communication device and including an elongate conductive whip antenna portion and a choke defined over a portion of said elongate conductive whip antenna portion, thereby providing top loading, the top-loaded whip antenna having dual band capability.

Preferably, a helical antenna portion is mounted onto the whip antenna portion and is electrically insulated therefrom.

In accordance with a preferred embodiment of the present invention there is also provided a base element suitable for mounting onto the mobile communication device and the whip antenna portion is slidably retractable and extendible with respect to the base element.

Preferably, the choke is defined by a conductive tube which is arranged to coaxially overlie part of said elongate conductive whip antenna portion, one end of the conductive tube being mechanically and galvanically coupled to the whip antenna portion and the remainder of the conductive tube being spaced from the whip antenna portion. A dielectric insulator preferably is interposed between the conductive tube and the elongate conductive whip antenna portion.

Preferably, the conductive tube is galvanically connected to the conductive whip antenna portion at a location adjacent an outward facing end of the conductive whip antenna portion.

The dual-band capability of the antenna preferably includes capability for simultaneously handling transmission of a first band including at least one of GSM and CDMA and a second band including at least one of GPS and Bluetooth.

Additionally or alternatively, the dual-band capability of the antenna includes capability for simultaneously handling transmission of a first band including a cellular communication band and a second band including a GPS band.

In accordance with a preferred embodiment of the present invention, the conductive whip antenna portion functions as a ¼ wave element.

Preferably, 50-ohm impedance matching is realized for dual bands without requiring a matching circuit.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
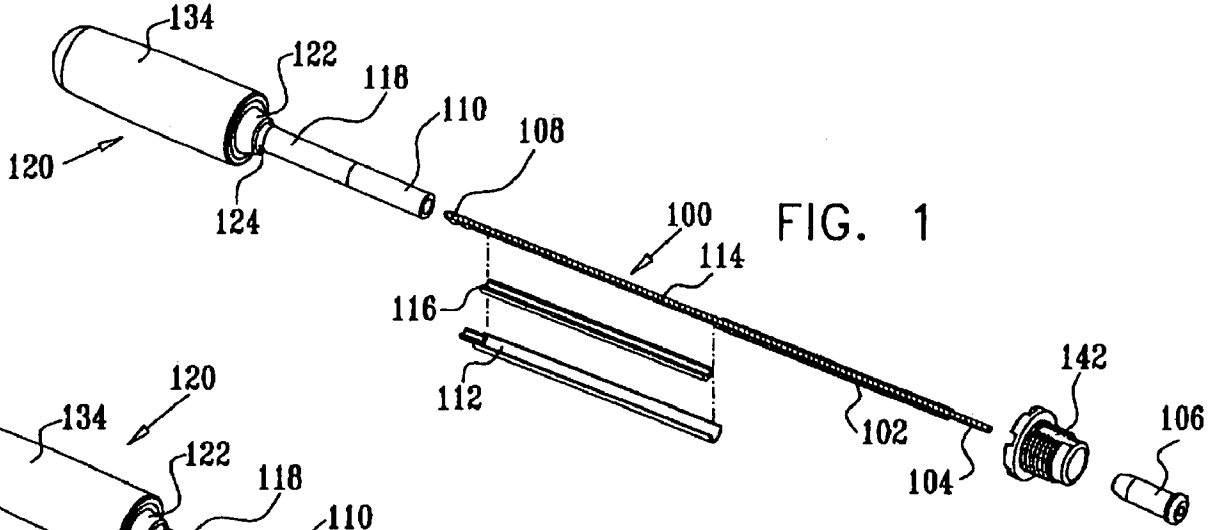
FIG. 1 is a partially exploded, partially sectional illustration of an antenna constructed and operative in accordance with a preferred embodiment of the present invention.
Figure 2:
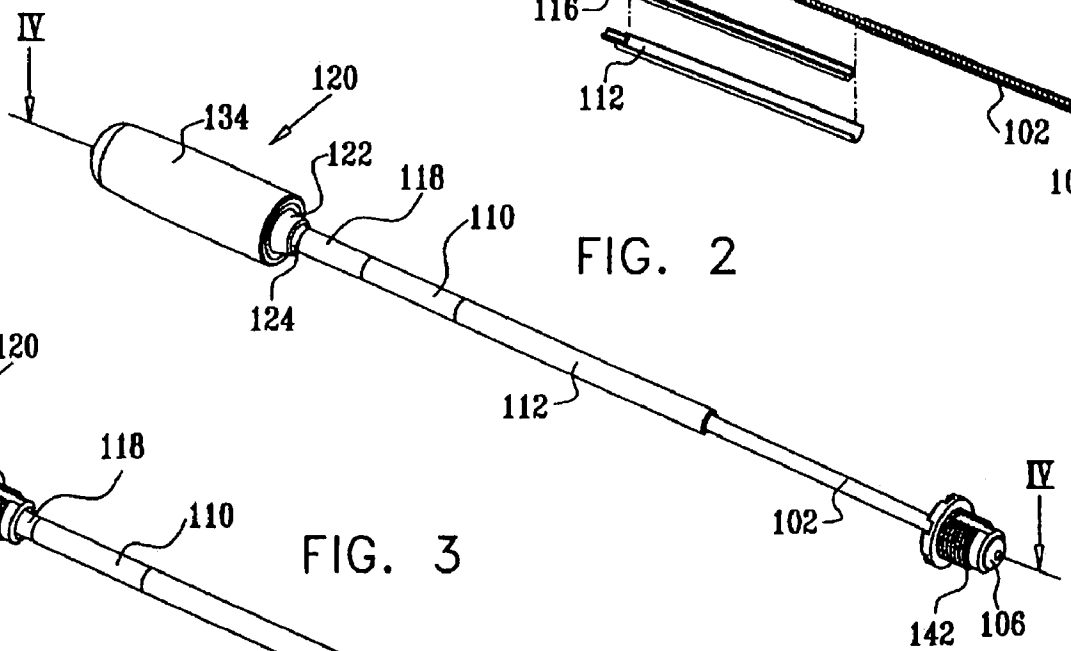
FIGS. 2 and 3 are pictorial illustrations of the antenna of FIG. 1 in respective extended and retracted operative positions.
Figure 3:
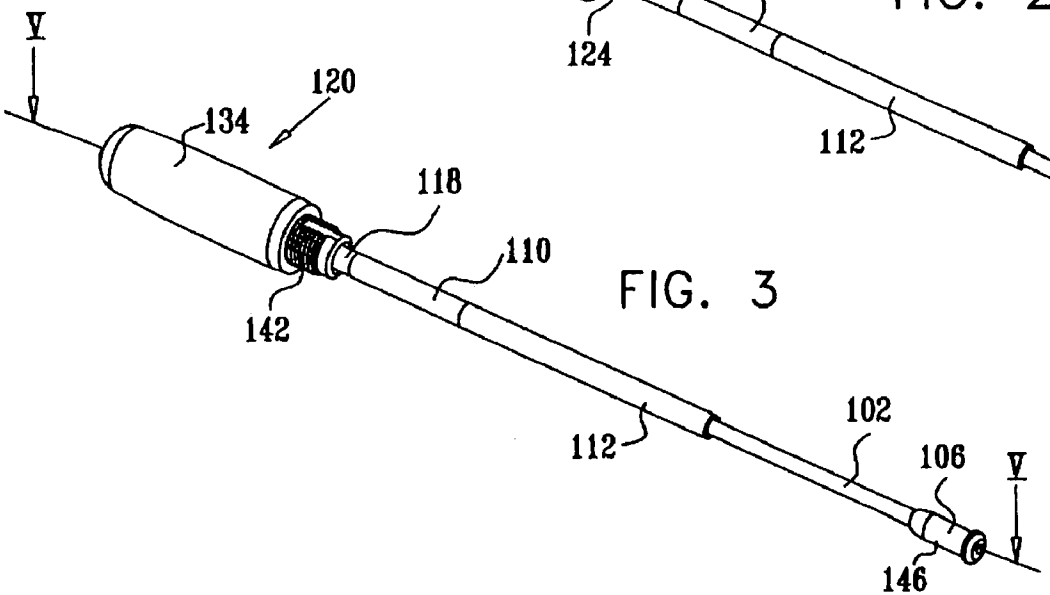

Reference is now made to FIGS. 1–7, which illustrate an antenna constructed and operative in accordance with a preferred embodiment of the present invention. FIGS. 1–7 illustrate the present invention embodied in a top helical antenna of the general type described in U.S. Pat. No. 5,204,687, the disclosure of which is hereby incorporated by reference.

As seen in FIGS. 1–7, the antenna is particularly characterized in that it includes an electrically conductive elongate whip portion 100 preferably formed of NiTi wire which is coated along a portion of its length with a conventional plastic electrically insulative coating 102. At an inward facing end 104 of whip portion 100, at which the plastic insulative coating 102 is removed, there is mounted a conductive, forwardly tapered connector element 106.

At its outward facing end 108, at which the plastic insulative coating 102 is also removed, whip portion 100 is mechanically attached to a dielectric antenna shaft portion 110, typically formed of plastic, and electrically and mechanically attached, preferably by crimping, to an electrically conductive tube 112, which overlies a portion 114 of whip portion 100. Tube 112 is electrically insulated from whip portion 100, other than at end 108 where it is electrically connected thereto. Preferably a dielectric material 116 of preselected electrical characteristics is interposed between whip portion 100 and tube 112 in place of plastic insulative coating 102. Alternatively plastic insulative coating 102 is disposed between tube 112 and the underlying length of whip portion 100. Tube 112 defines, together with whip portion 100, a choke having characteristics which substantially enhance antenna performance.

Mounted onto a portion of dielectric shaft portion 110 is a conductive sleeve 118, onto which is fixedly mechanically and electrically connected a top helical antenna assembly 120. Assembly 120 includes an electrically insulative base element 122, which defines a bore 124 of dimensions selected so as to fixedly engage an outer surface 126 of conductive sleeve 118.

Disposed in electrically conductive engagement with base element 122 and supported on a conductive base 128, preferably integrally formed with sleeve 118, and partially wound around an end portion 130 of dielectric shaft portion 110 is a helical antenna element 132. Helical antenna element 132 is preferably surrounded by a dielectric top helical antenna assembly housing 134.

An outwardly threaded, electrically conductive base element 142 engages a suitably threaded socket (not shown) in a communications device such as a cellular telephone. Preferably base element 142 defines a bore 144 of dimensions and surface friction characteristics selected so as to slidably but frictionally retainably engage the outer surface 146 of connector element 106 and the outer surface 126 of sleeve 112, which preferably has generally the same outer dimensions as surface 146. In such a way, depending on whether a user has placed the whip portion 100 in an extended or retracted position, illustrated in FIGS. 2 & 4 and 3 & 5 respectively, frictional engagement with bore 144 retains the whip portion 100 in the user-selected position.

Either but not both of connector element 106 and sleeve 118 electrically engages electrically conductive base element 142. In such a way, depending on whether a user has placed the whip portion 100 in an extended or retracted position, illustrated in FIGS. 2 & 4 and 3 & 5 respectively, frictional engagement with bore 144 retains the whip portion 100 in the user-selected position.

Figure 4:
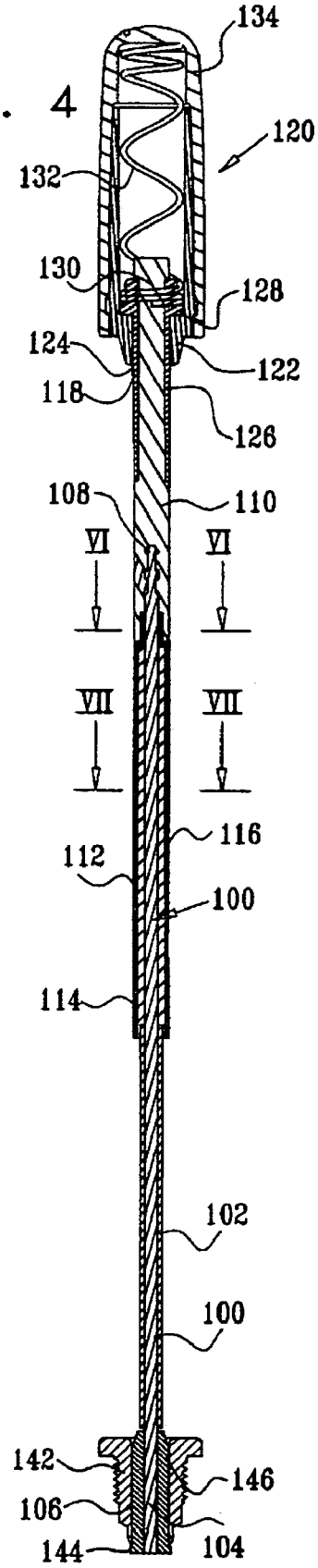
FIGS. 4 and 5 are respective sectional illustrations corresponding to FIGS. 2 and 3.
Figure 5:
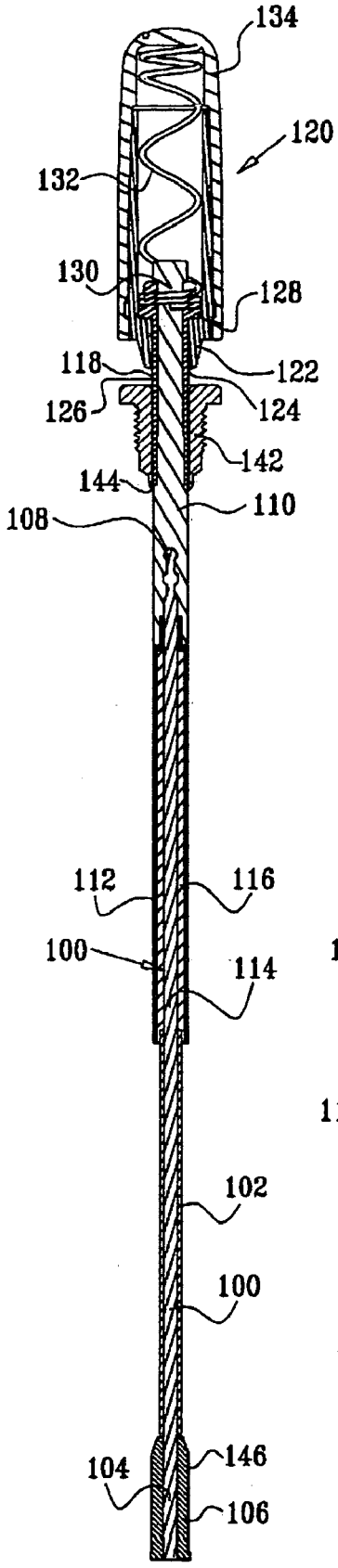
Figure 6:
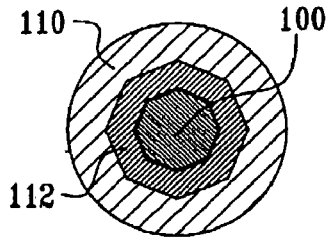
FIGS. 6 and 7 are sectional illustrations taken along lines VI—VI and VII—VII respectively in FIG. 4.
Figure 7:
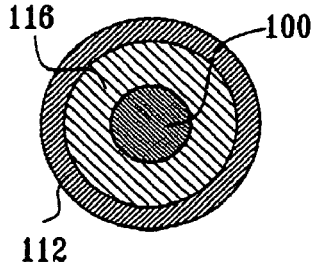
Figure 8:
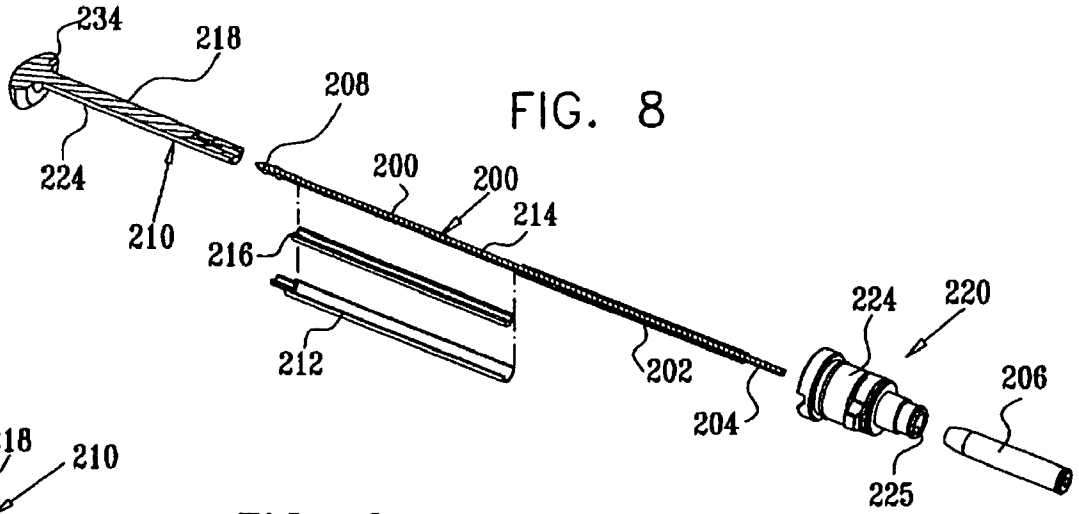
FIG. 8 is a partially exploded, partially sectional illustration of an antenna constructed and operative in accordance with another preferred embodiment of the present invention.
Figure 9:
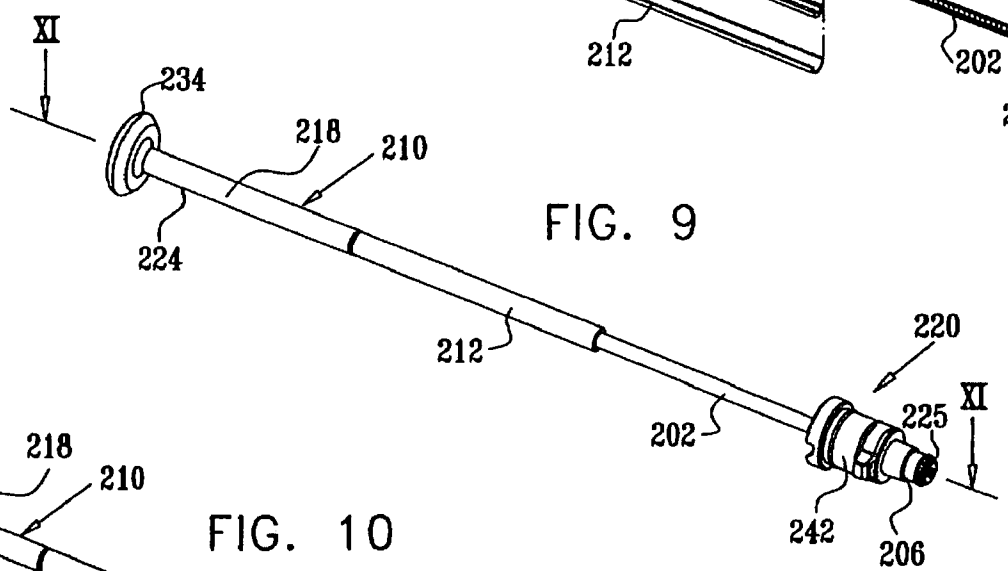
FIGS. 9 and 10 are pictorial illustrations of the antenna of FIG. 8 in respective extended and retracted operative positions.
Figure 10:
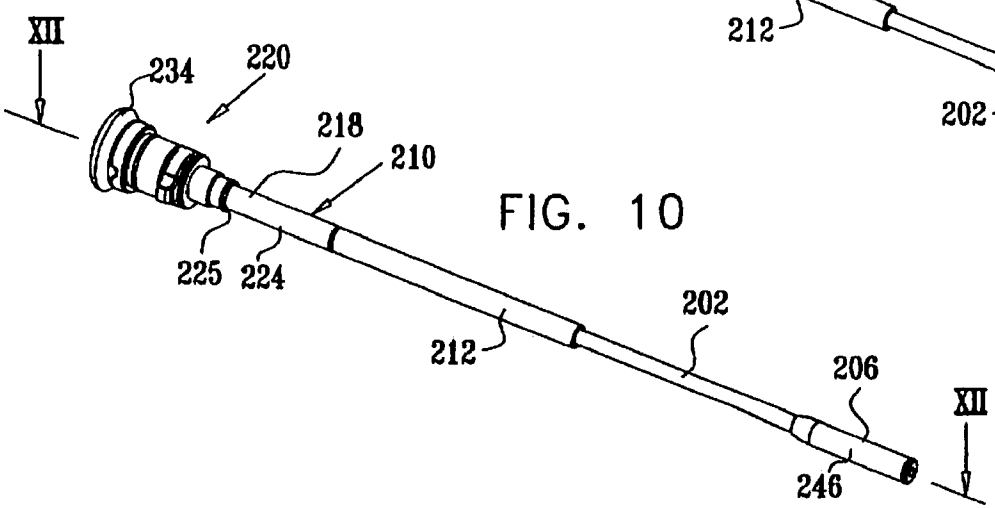

It may be appreciated from a consideration of FIGS. 1–7 and more particularly FIGS. 4 and 5, that when the whip portion 100 is in an extended position, as shown in FIG. 4, the whip portion 100 is directly electrically coupled to base element 142 and radiates in at least two different frequency bands. When the whip portion 100 is in a retracted position, as shown in FIG. 5, helical antenna portion 132 is directly electrically coupled to base element 142 via sleeve 118 and also preferably radiates in the two different frequency bands.

It is a particular feature of the present invention that the above-described structure provides a top-loaded whip antenna having a relatively short whip length, but having dual band functionality as well as performance characteristics of a whip antenna whose whip length is significantly greater.

The antenna of FIGS. 1–7, due to its robust design and operation in two bands, effectively provides two antennas in a single structure. Such two antennas can be, for example, a CDMA or GSM antenna and a GPS or Bluetooth antenna.

Reference is now made to FIGS. 8–14, which illustrate an antenna constructed and operative in accordance with a preferred embodiment of the present invention. FIGS. 8–14 illustrate the present invention embodied in a whip antenna.

As seen in FIGS. 8–14, the antenna is particularly characterized in that it includes an electrically conductive elongate whip portion 200 preferably formed of NiTi wire which is coated along a portion of its length with a conventional plastic electrically insulative coating 202. At an inward facing end 204 of whip portion 200, at which the plastic insulative coating 202 is removed, there is mounted a conductive, forwardly tapered connector element 206, which extends outwardly over part of the insulative coating 202.

At its outward facing end 208, at which the plastic insulative coating 202 is also removed, whip portion 200 is mechanically attached to an antenna top member 210, typically formed of a dielectric material, and electrically and mechanically attached, preferably by crimping, to an electrically conductive tube 212, which overlies a portion 214 of whip portion 200. Tube 212 is electrically insulated from whip portion 200, other than at end 208 where it is galvanically connected thereto. Preferably a dielectric material 216 of preselected electrical characteristics is interposed between whip portion 200 and tube 212 in place of plastic insulative coating 202. Alternatively plastic insulative coating 202 is disposed between tube 212 and the underlying length of whip portion 200. Tube 212 defines together with whip portion 200 a choke having characteristics which substantially enhance antenna performance.

At a given time, either but not both of connector element 206 and antenna top member 210 mechanically engage an antenna assembly retaining collar assembly 220. Assembly 220 includes an electrically conductive base element 222, which engages a suitably configured electrical connector (not shown) in a communications device such as a cellular telephone. Assembly 220 also preferably includes a bayonet-type mechanical connector portion 224, which engages a suitably configured bayonet-type socket (not shown) in the communications device such as a cellular telephone. Preferably base element 222 defines a bore 225 of dimensions and surface friction characteristics selected so as to slidably but frictionally retainably engage the outer surface 226 of connector element 206 and the outer surface 228 of antenna top member 210, which preferably has generally the same outer dimensions as surface 226. In such a way, depending on whether a user has placed the whip portion 200 in an extended or retracted position, illustrated in FIGS. 9 & 11 and 10 & 12 respectively, frictional engagement with bore 225 retains the whip portion 200 in the user-selected position.

Figure 11:
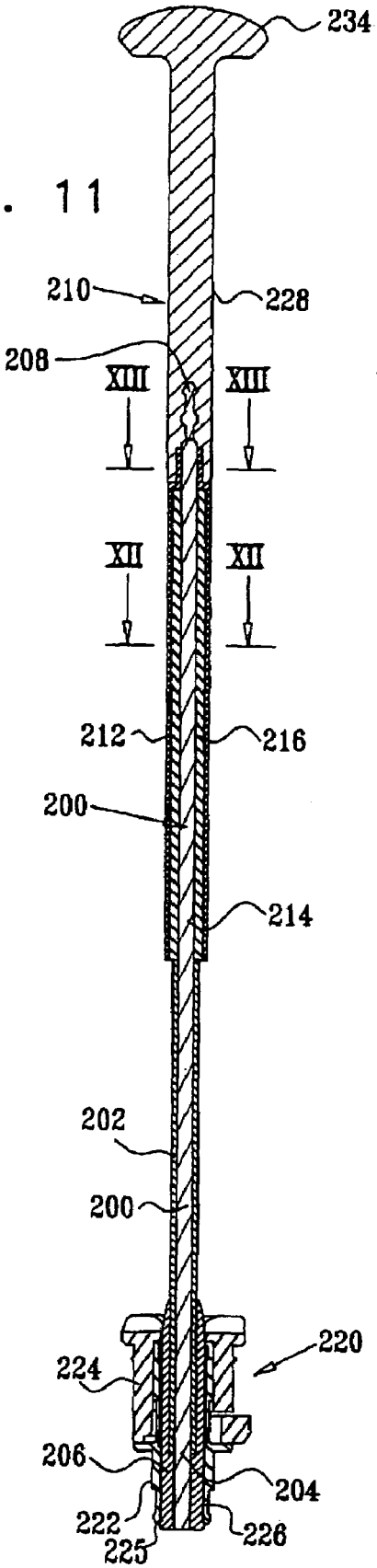
FIGS. 11 and 12 are respective sectional illustrations corresponding to FIGS. 9 and 10.
Figure 12:
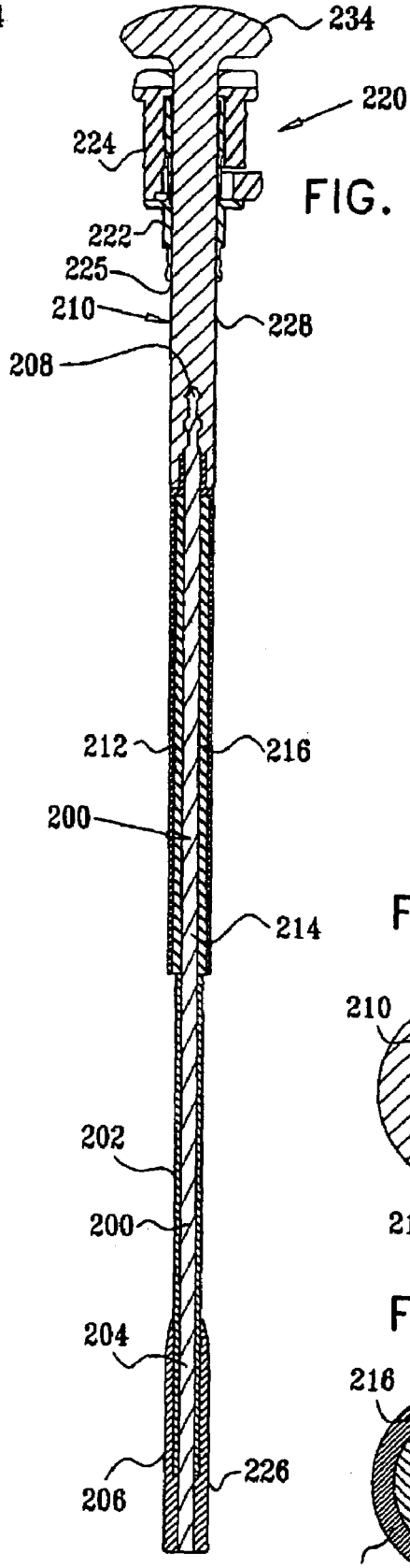
Figure 13:
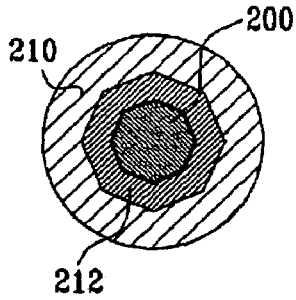
FIGS. 13 and 14 are sectional illustrations taken along lines XIII—XIII and XIV—XIV respectively in FIG. 11.
Figure 14:
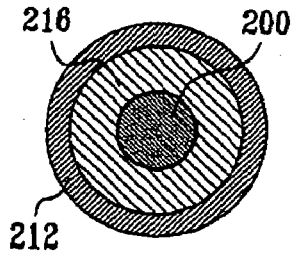

It may be appreciated from a consideration of FIGS. 8–14 and more particularly FIGS. 11 and 12, that when the whip portion 200 is in an extended position, as shown in FIG. 11, the whip portion 200 is directly electrically coupled to base element 222. When the whip portion 200 is in a retracted position, as shown in FIG. 12, the whip portion 200 is no longer electrically coupled to base element 222.

It is a particular feature of the present invention that the above-described structure provides a top-loaded whip antenna having a relatively short whip length, but having dual-band capability as well as performance characteristics of a whip antenna whose whip length is significantly greater.

Figure 15:
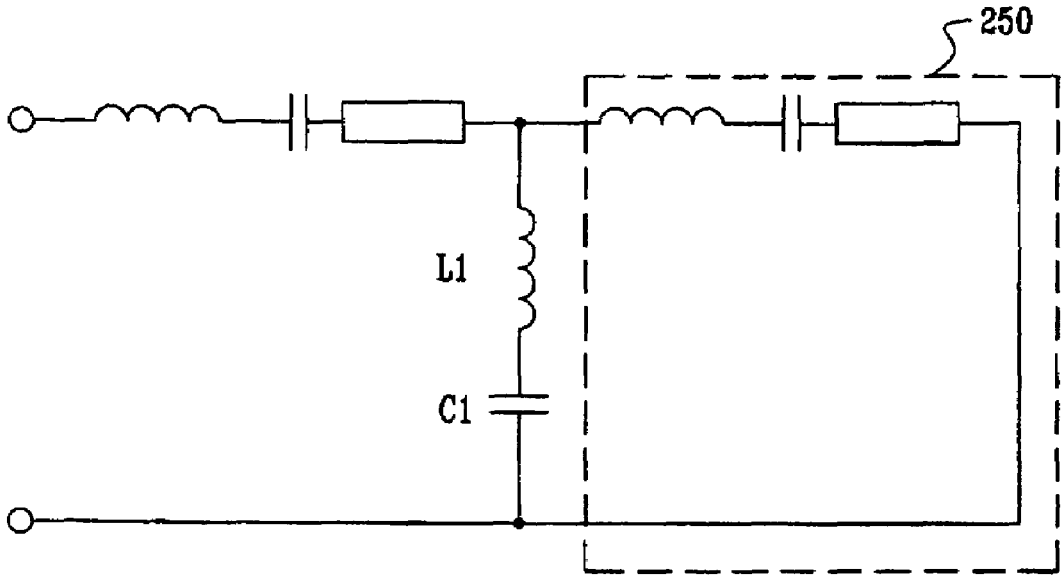
FIG. 15 is a simplified electrical equivalent circuit corresponding to the antenna of FIGS. 1–14 for operation in a high frequency band.
Figure 16:
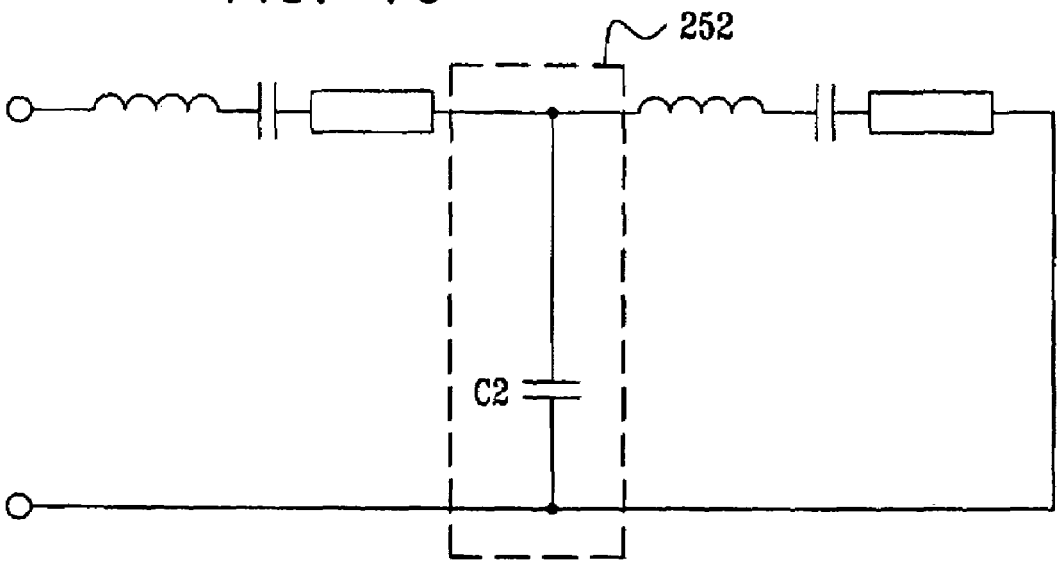
FIG. 16 is a simplified electrical equivalent circuit corresponding to the antenna of FIGS. 1–14 for operation in a low frequency band.

Reference is now made to FIGS. 15 and 16, which illustrate electrical equivalent circuits for operation of the antennas of FIGS. 1–14, respectively in a relatively high frequency band, such as 1500–2100 MHZ and in a relatively low frequency band, such as 750–1000 MHZ. In the electrical equivalent circuit of FIG. 15, the circuitry within block 250 is not operative, due to the resonance of inductor L1 and capacitor C1. In the electrical equivalent circuit of FIG. 16, inductor L1 (FIG. 15) is not effective due to top loading, producing a capacitance C2 appearing in block 252 and thus, the entire circuit appearing in FIG. 16 is operative.

It will be appreciated by persons skilled in the art that the present invention is not limited by what has been particularly shown and described hereinabove. Rather the scope of the present invention includes both combinations and sub-combinations of various features described hereinabove as well as variations and modifications thereof which would occur to persons reading the foregoing description and which are not in the prior art.

The invention claimed is:

1. A top-loaded whip antenna particularly suitable for use in a compact mobile communication device and comprising:

an elongate conductive whip antenna portion;

an electrically conductive tube defining, together with said elongate conductive whip antenna portion, a choke over a portion of said elongate conductive whip antenna portion, thereby providing top loading; and a base element suitable for mounting onto said mobile communication device, said whip antenna portion being slidably retractable and extendible with respect to said base element, said top-loaded whip antenna having dual band capability, said conductive tube being arranged to coaxially overlie said portion of said elongate conductive whip antenna portion, one end of said conductive tube being mechanically and galvanically coupled to said whip antenna portion and the remainder of said conductive tube being spaced from said whip antenna portion.

2. A top-loaded whip antenna according to claim 1 and also comprising a helical antenna portion mounted onto said whip antenna portion and being electrically insulated therefrom.

3. A top-loaded antenna according to claim 2 and wherein said conductive tube is arranged to coaxially overlie said portion of said elongate conductive whip antenna portion, one end of said conductive tube being mechanically and galvanically coupled to said whip antenna portion and the remainder of said conductive tube being spaced from said whip antenna portion.

4. A top-loaded antenna according to claim 3 and wherein a dielectric insulator is interposed between said conductive tube and said elongate conductive whip antenna portion.

5. A top-loaded antenna according to claim 2 and wherein said dual-band capability includes capability for simultaneously handling transmission of a first band including at least one of GSM and CDMA and a second band including at least one of GPS and Bluetooth.

6. A top-loaded antenna according to claim 2 and wherein said dual-band capability includes capability for simultaneously handling transmission of a first band including a cellular communication band and a second band including a GPS band.

7. A top-loaded antenna according to claim 3 and wherein said conductive tube is galvanically connected to said conductive whip antenna portion at a location adjacent an outward facing end of said conductive whip antenna portion.

8. A top-loaded antenna according to claim 2 and wherein said conductive while antenna portion functions as a ¼wave length element.

9. A top-loaded antenna according to claim 1 and wherein a dielectric insulator is interposed between said conductive tube and said elongate conductive whip antenna portion.

10. A top-loaded antenna according to claim 1 and wherein said conductive tube is arranged to coaxially overlie said portion of said elongate conductive whip antenna portion, one end of said conductive tube being mechanically and galvanically coupled to said whip antenna portion and the remainder of said conductive tube being spaced from said whip antenna portion.

11. A top-loaded antenna according to claim 10 and wherein a dielectric insulator is interposed between said conductive tube and said elongate conductive whip antenna portion.

12. A top-loaded antenna according to claim 1 and wherein said dual-band capability includes capability for simultaneously handling transmission of a first band including at least one of GSM and CDMA and a second band including at least one of GPS and Bluetooth.

13. A top-loaded antenna according to claim 1 and wherein said dual-band capability includes capability for simultaneously handling transmission of a first band including a cellular communication band and a second band including a GPS band.

14. A top-loaded antenna according to claim 1 and wherein said conductive tube is galvanically connected to said conductive whip antenna portion at a location adjacent an outward facing end of said conductive whip antenna portion.

15. A top-loaded antenna according to claim 1 and wherein said conductive whip antenna portion functions as a ¼wave length element.

* * * * *